US009799462B2

(12) United States Patent
Feil et al.

(10) Patent No.: US 9,799,462 B2
(45) Date of Patent: Oct. 24, 2017

(54) SWITCHING DEVICE WITH A HEAT EXTRACTION APPARATUS

(75) Inventors: Wolfgang Feil, Schwandorf (DE); Rainer Kreutzer, Weiden (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 230 days.

(21) Appl. No.: 13/811,050

(22) PCT Filed: Jun. 30, 2011

(86) PCT No.: PCT/EP2011/061049

§ 371 (c)(1),
(2), (4) Date: Jan. 18, 2013

(87) PCT Pub. No.: WO2012/013440

PCT Pub. Date: Feb. 2, 2012

(65) Prior Publication Data

US 2013/0118869 A1 May 16, 2013

(30) Foreign Application Priority Data

Jul. 30, 2010 (EP) ..... 10008006

(51) Int. Cl.
*H01H 1/62* (2006.01)
*H01H 71/14* (2006.01)
*H01H 9/52* (2006.01)

(52) U.S. Cl.
CPC ..... *H01H 1/62* (2013.01); *H01H 71/14* (2013.01); *H01H 9/52* (2013.01); *H01H 2009/526* (2013.01)

(58) Field of Classification Search
CPC ..... H01H 1/62; H01H 71/14; H01H 71/142; H01H 9/52; H01H 45/12; H01H 50/12;
(Continued)

(56) References Cited

U.S. PATENT DOCUMENTS 2,606,981 A 8/1952 Degler
2,732,451 A 1/1956 Degler
(Continued)

FOREIGN PATENT DOCUMENTS

CN 201402758 Y 2/2010
DE 842809 C 6/1952
(Continued)

OTHER PUBLICATIONS

Chinese Office Action and English translation thereof dated Sep. 24, 2014.

(Continued)

*Primary Examiner* — Anatoly Vortman
*Assistant Examiner* — Jacob Crum
(74) *Attorney, Agent, or Firm* — Harness, Dickey & Pierce, P.L.C.

(57) ABSTRACT

A switching device is disclosed, in particular a circuit breaker, with a thermal release, on which a moving switching piece is arranged by a contact link support. The moving switching piece is borne on a spring body and is arranged opposite stationary switching pieces. A heat-extraction apparatus composed of a heat-dissipating material is in each case arranged at the side, along the stationary switching pieces.

9 Claims, 5 Drawing Sheets

(58) Field of Classification Search
CPC ..... H01H 85/47; H01H 2009/526; H01H 2033/6613
USPC ..... 200/289; 337/109, 112, 180
See application file for complete search history.

(56) References Cited

U.S. PATENT DOCUMENTS

| | | | | |
|---|---|---|---|---|
| 2,906,839 | A | 9/1959 | Ashe et al. | |
| 3,764,765 | A * | 10/1973 | Olashaw | 200/289 |
| 4,005,297 | A * | 1/1977 | Cleaveland | 218/118 |
| 4,743,720 | A * | 5/1988 | Takeuchi | H01H 9/302 218/24 |
| 5,322,982 | A * | 6/1994 | Leger et al. | 200/401 |
| 6,856,503 | B2 * | 2/2005 | Apfelbacher | H01H 50/021 165/121 |
| 7,199,318 | B2 | 4/2007 | Buxton et al. | |
| 8,717,746 | B2 * | 5/2014 | Kaufmann et al. | 361/678 |
| 2005/0006350 | A1 | 1/2005 | Buxton et al. | |
| 2007/0045235 | A1 * | 3/2007 | Gerving | 218/38 |
| 2009/0293499 | A1 * | 12/2009 | Bell et al. | 62/3.2 |
| 2012/0056699 | A1 | 3/2012 | Valdemarsson | |

FOREIGN PATENT DOCUMENTS

| | | | |
|---|---|---|---|
| DE | 876563 | C | 5/1953 |
| DE | 1096468 | B | 1/1961 |
| DE | 1141012 | B | 12/1962 |
| DE | 102006057814 | A1 | 4/2008 |
| DE | 102006057814 | A1 | 4/2008 |
| EP | 1484776 | A2 | 12/2004 |
| EP | 2251887 | A1 | 11/2010 |

OTHER PUBLICATIONS

International Search Report PCT/ISA/210 for International Application No. PCT/EP2011/061049 Dated on Sep. 22, 2011.
European Priority Document for EP 10008006.8 (Not yet published).

* cited by examiner

SWITCHING DEVICE WITH A HEAT EXTRACTION APPARATUS

PRIORITY STATEMENT

This application is the national phase under 35 U.S.C. §371 of PCT International Application No. PCT/EP2011/061049 which has an International filing date of Jun. 30, 2011, which designated the United States of America and which claims priority to European patent application number EP 10008006 filed Jul. 30, 2010, the entire contents of each of which are hereby incorporated herein by reference.

FIELD

At least one embodiment of the invention generally relates to a switching device, in particular a circuit breaker, with a thermal release, on which a moving switching piece is arranged by a contact link support, the moving switching piece being mounted on a spring body and is arranged opposite stationary switching pieces.

BACKGROUND

Circuit breakers are developed in various installation sizes. An installation size is composed in this case of device variants having a rated current series to be established expediently. With an increasing rated current of a device, its power loss increases in a very disproportionate manner. The device variant with the highest rated current with a given installation size is determined such that for precisely this current, the power loss with a given housing volume is still without disadvantageous consequences in terms of the requirements of the switching device through its service life. If still higher rated currents are required, a larger design is developed. From the customer's point of view, it is however desirable to drive the maximum rated current within an installation size still further upwards. In order to achieve this, measures must be taken to configure the transport of heat from the housing volume in a technically more efficient manner.

There are in principle two possibilities in terms of dealing with high temperatures within a protective housing on account of unavoidable electrical power losses. On the one hand, all materials can be optimized to such a degree that they also fulfill their functional requirements at a high temperature level. This is nevertheless often not a cost-effective solution. The other procedure consists in forcing the removal of the generated heat from the housing by way of technical measures. Active cooling measures by means of housing ventilators, heat pipe arrangements or even coolant circuits form the prior art for electronic products. In order to be able to dissipate large locally generated heat quantities, this heat is distributed onto large surfaces by way of cooling elements. In this way the cooling elements are thermally bound to the components with a high electrical power loss, but are electrically insulated therefrom. Completely passively cooled systems are constructed here such that there can be a direct ambient air flow onto the required cooling elements.

The disadvantage of the prior art is that the previous heat extraction elements could not be disposed in the optimum space-saving arrangement in the switching device.

SUMMARY

At least one embodiment of the present invention resides accordingly in creating a switching device which enables an optimum space-saving arrangement for the heat extraction process.

Advantageous embodiments and developments, which can be used individually or combination with one another, form the subject matter of the dependent claims.

In accordance with at least one embodiment of the invention by a switching device, in particular a circuit breaker, with a thermal release, on which a moving switching piece is arranged by a contact link support which moving switching piece is mounted on a spring body and is arranged opposite stationary switching pieces. The invention is characterized in that a heat extraction apparatus made of a heat-dissipating material is arranged laterally on the stationary switching pieces in each instance.

BRIEF DESCRIPTION OF THE DRAWINGS

Further advantages and embodiments of the invention are described in more detail below with the aid of exemplary embodiments based on the drawing, in which, shown schematically.

DETAILED DESCRIPTION OF THE EXAMPLE EMBODIMENTS

Figure 1:
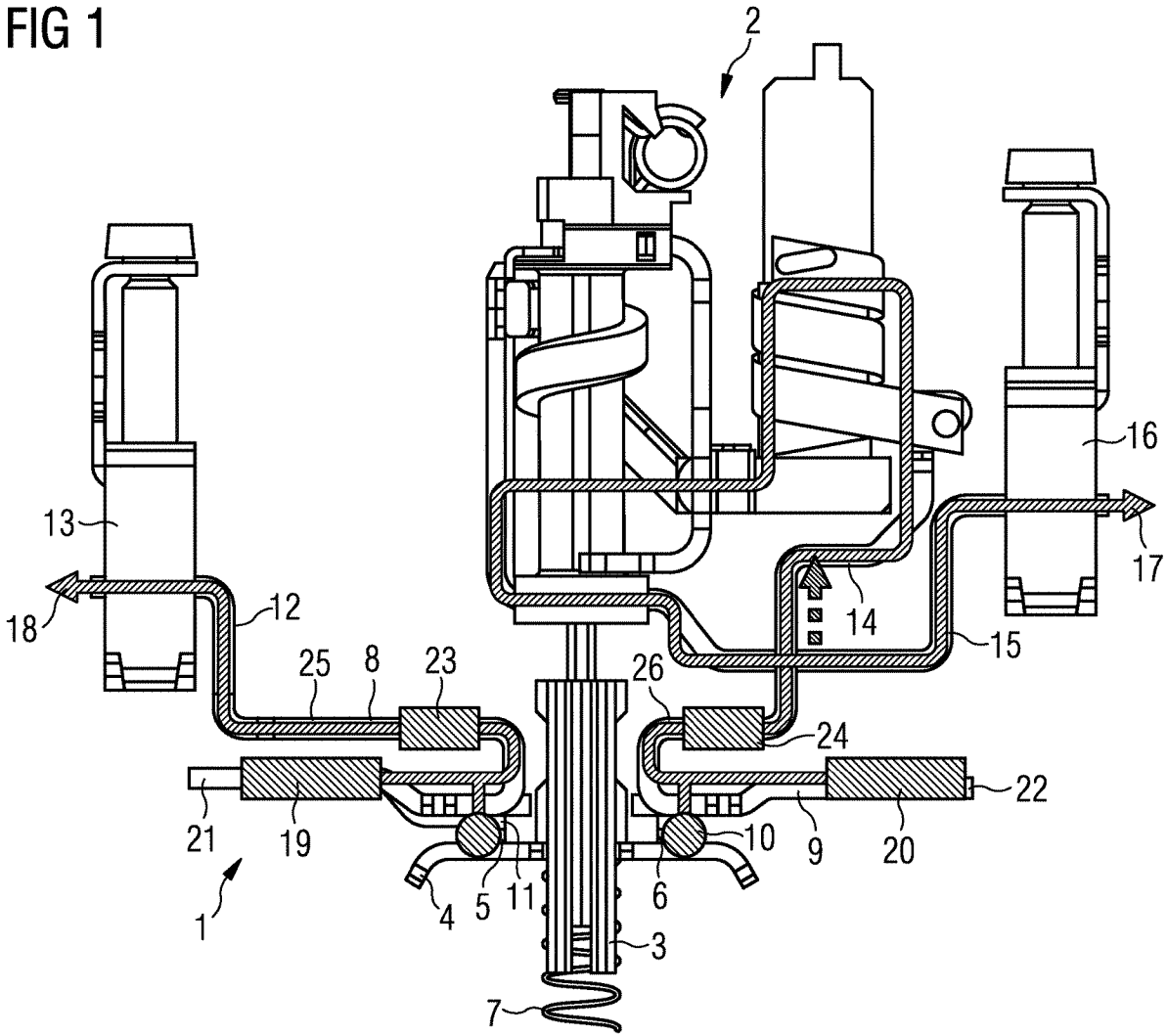
FIG. 1 shows a sectional representation of a switching device, in particular a circuit breaker, having a heat dissipation behavior shown after a switching process.

In accordance with at least one embodiment of the invention the heat extraction problem is solved by opening a second important heat extraction route along the current path, if one uses the main thermal source as the basis, in other words the contact link. Aside from the first heat extraction direction leading into the device, this additional second path, guides the busbars away from the contact points in parallel to the baffles in the direction of the front faces. This end of the current path embodiment was previously a blind alley, when considered in terms of heat, and only served to guide the short-circuit arc in the direction of the baffle facility. The realization of a second heat path can be achieved by way of introducing large-surface cooling elements, like for instance cooling plates, preferably into the phase separating walls of switching devices. These cooling elements are directly or indirectly electrically insulated for instance and are connected in an effective heat-conducting manner to the busbars of the devices for instance. They then pass in a planar manner into cavities in the chamber separating walls of the switching devices which in most cases consist of plastic.

Continuing these cooling lugs into part of the chamber separating ribs, which lie outside of the device carcass, is particularly advantageous. These outwardly placed ribs are currently used primarily to enlarge the insulation path, in other words the air gap and creepage distance between the individual poles of the devices. If the thermal cover of the thermally poor conducting rib plastic remains small, sufficient air can be output into the ambient. If the ribs also extend over the entire device height, the surface dissipating into the surrounding air heat is relatively large. When arranging the devices side by side contrary to the lateral device surfaces, these ribs incidentally remain uncovered and are therefore extremely effective. An electric protection against operator contact with the metallic cooling lugs is provided by the plastic sheathing.

A further alternative increasing the degree of efficiency resides in not using the cooling lugs in a contact-protected manner within the plastic ribs, but instead introducing them directly into the air. The necessary protection against operator contact must in this case be ensured by way of electrically insulating, but nevertheless effective heat-conducting intermediate layers between the current path and the cooling lug, like for instance heat-conductive films or ceramic plates known from the prior art.

An advantage of the inventive heat extraction apparatus of at least one embodiment resides in a second effective current path heat extraction route having been found, so that larger power losses can be dissipated so that higher rated current densities of the devices are enabled with a constant installation volume.

A structural advantage resides in the heat discharge surfaces not being useable or covered. As a result, an efficient heat discharge can take place. On account of the second heat extraction route observed from the contact point into the cooling surface, a favorable decoupling of the thermal release takes place, for instance of a bimetal from heat-specific deviations in the contact transition point. As a result, the release behavior of the device is influenced favorably. At least one embodiment of the inventive heat extraction apparatus therefore achieves both a reduction in the temperature level and also an improvement in the limit current release behavior.

In a particularly advantageous embodiment, provision is made for the heat extraction apparatus to be embodied from a heat-conducting material, in particular a cooling plate. These large cooling plates enable the heat quantity previously present within the switching devices in a more or less punctual manner to be better dissipated in the current path by relatively large cooling or heat distribution surfaces. These cooling plates are advantageously also embodied as cooling ribs, which likewise enable an efficient heat transport.

In an advantageous variant of at least one embodiment of the inventive heat extraction apparatus, provision is made for the heat extraction apparatus to be arranged on the stationary switching pieces and on a connecting tongue of the thermal release. This lateral positioning of at least one embodiment of the inventive heat extraction apparatus on the stationary switching pieces enables a space-optimized arrangement, which enables effective heat transport.

In addition, provision is advantageously made for the heat extraction apparatus to be arranged in chamber separating walls of the switching device. At least one embodiment of the inventive cooling surfaces are insulated in this way and positioned in a space-optimized manner between the phase separating walls of the switching device. The cooling surfaces, if they are arranged between the phases, can also extend beyond the device base carcass, into outwardly lying, if necessary insulated ribs on one or both sides. The advantage consists in the heat discharge via these outer lying large-surface ribs being extremely efficient on account of the direct contact with the surrounding air.

At least one embodiment of the inventive heat extraction apparatus of the switching devices shown here, in particular for circuit breakers, makes possible a second effective current path heat extraction route, so that greater power losses can be dissipated so that higher rated current densities of the devices are possible with the installation volume remaining the same. Here the heat discharge surfaces are integrated in a space-optimized manner into the switching device in the form of cooling plates such that the surfaces are neither used nor covered. On account of the second heat extraction path observed from the contact point into the cooling plate, a favorable decoupling of the thermal release from heat-specific fluctuations of the contact transition point advantageously takes place, as a result of which the release behavior of the switching device is influenced favorably. The space-optimized heat extraction apparatus described here therefore enables both a reduction in the temperature level overall and also an improvement in the limit current release behavior.

FIG. 1 shows a switching device 1, in particular a circuit breaker, including a thermal release 2 on which a moveable switching piece 4 is arranged by way of a contact link support 3. The moveable switching piece 4 is embodied as a moveable contact link with two contact points 5, 6. The moveable switching piece 4 is mounted on a spring element 7 in the contact link support 3, and arranged opposite stationary switching pieces 8, 9. The stationary switching pieces 8, 9 are arranged to the right or left of the contact link support 3 and each comprise a contact point 10, 11, which, in the case of a switching process, strike the contact points 5, 6 of the moveable switching piece 4.

The stationary switching piece 8 is preferably embodied in a U shape and comprises a projection 12 which leads to a terminal clamp 13. The stationary switching piece 9 is likewise embodied in a U shape with a long and a short limb, wherein the shorter limb leads via a projection 14 to the thermal release 2. A connecting tongue 15 leads from the thermal release 2 to a further terminal clamp 16.

In FIG. 1, the heat dissipation behavior 17, 18 is also shown after a switching process. After a switching process, large thermal fields 19, 20 initially form on the free limbs 21, 22 of the fixed switching piece 8, 9, which do not lead to terminal clamp 13 and to the thermal release 2. Further thermal fields 23, 24, which are somewhat less marked than the thermal fields 18, 20, are found on the other two limbs 25, 26 of the stationary switching pieces 8, 9. According to these somewhat less marked thermal fields 23, 24, the heat is further discharged in the direction of the terminal clamps 13 and via the thermal release 2 to the terminal clamp 16.

Figure 2:
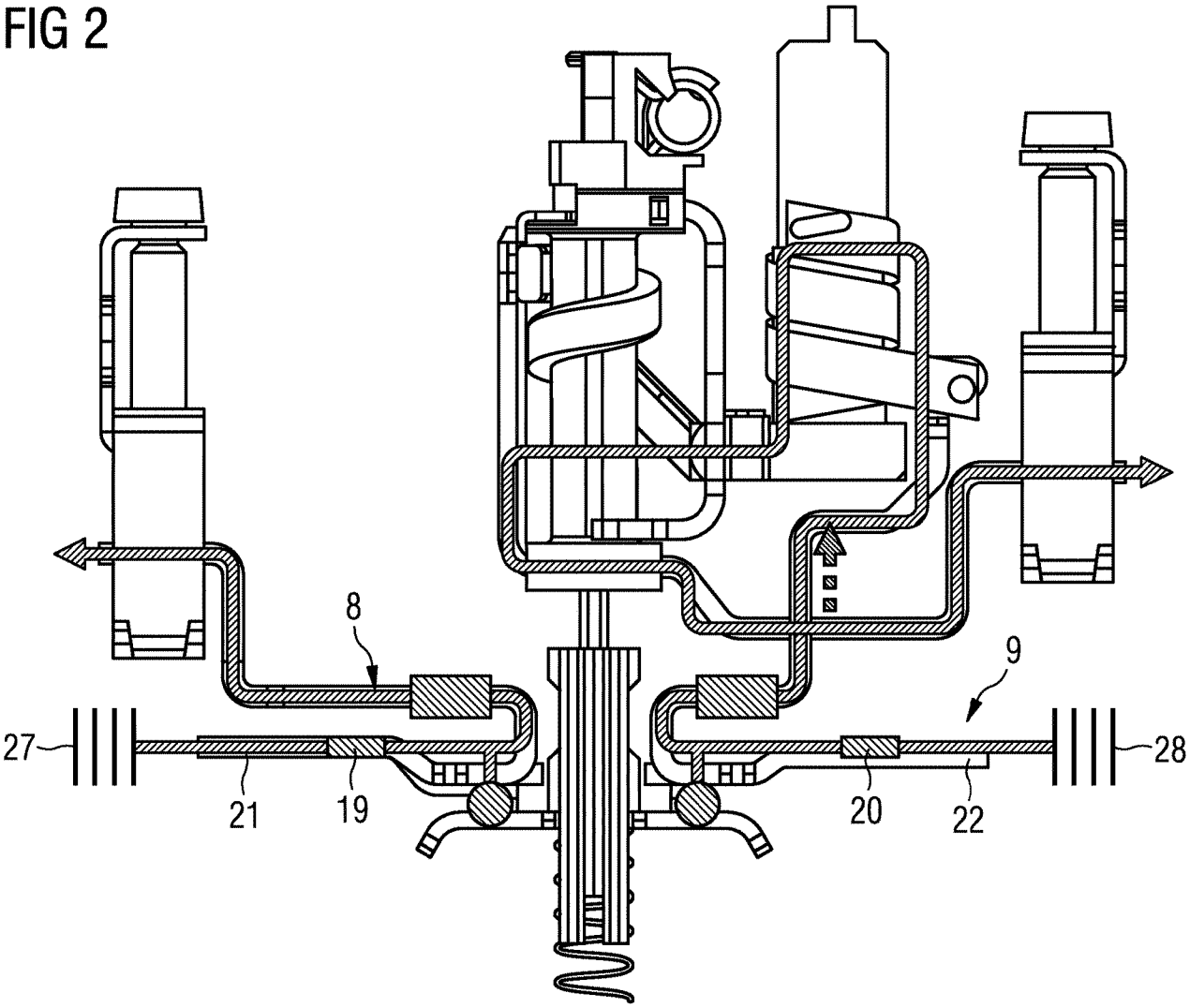
FIG. 2 shows a sectional representation of an embodiment of an inventive switching device having a heat extraction apparatus after a switching process with heat dissipation behavior.

FIG. 2 shows the representation according to FIG. 1, wherein heat extraction apparatuses 27, 28 are arranged on the free limbs 21, 22 of the stationary switching pieces 8, 9. These heat extraction apparatuses 27, 28 can be embodied for instance as cooling plates or cooling ribs. FIG. 2 further shows that the thermal fields 19, 20 are embodied significantly smaller by the inventive heat extraction apparatus 27, 28.

Figure 3:
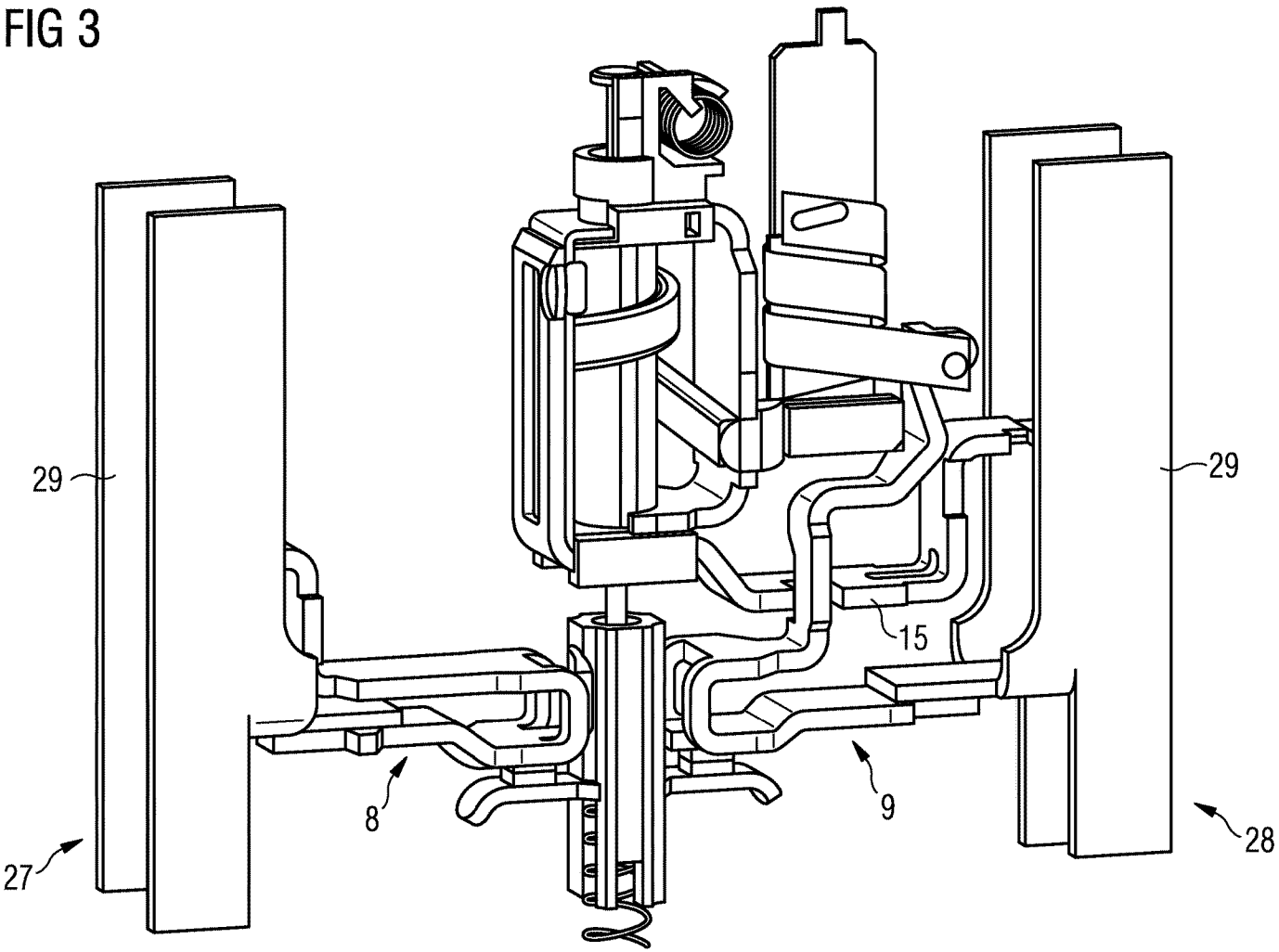
FIG. 3 shows a perspective representation of a switching device with a heat extraction apparatus embodied from cooling plates.

FIG. 3 shows a particularly advantageous embodiment of the inventive heat extraction apparatus 27, 28. In this example, the heat extraction apparatus 27, 28 is shown as cooling plate 29. The cooling plates 29 are preferably aligned in parallel with one another and arranged on the stationary switching pieces 8, 9 and on the connecting tongue 15.

Figure 4:
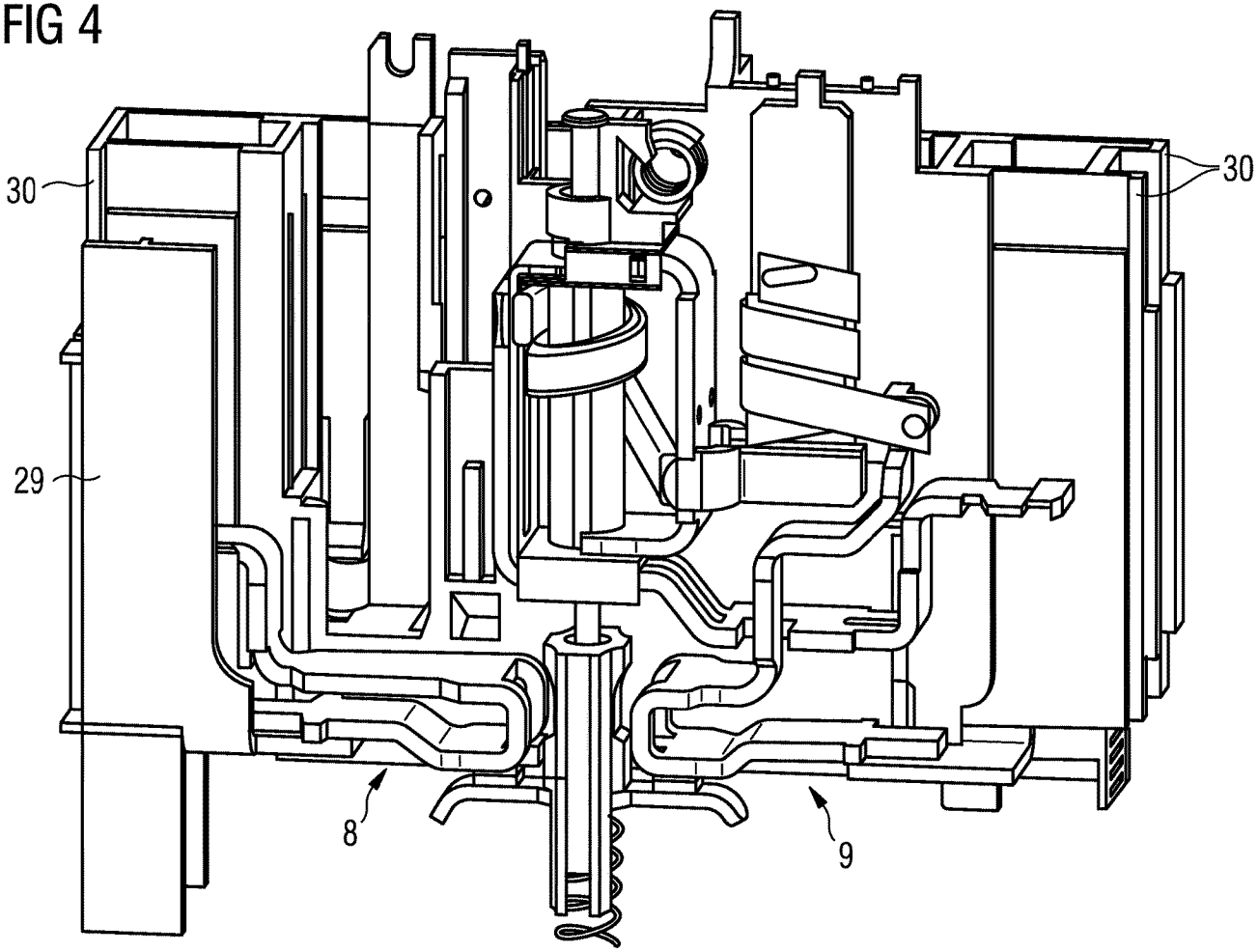
FIG. 4 shows a perspective representation of the switching device according to FIG. 3, wherein the cooling plates are expanded beyond the switch basic contour in the form of insulated ribs.

FIG. 4 shows the representation from FIG. 3, wherein the cooling plate 29 extends over the switch base contour in the form of insulated, if necessary housing-integrated ribs 30.

Figure 5:
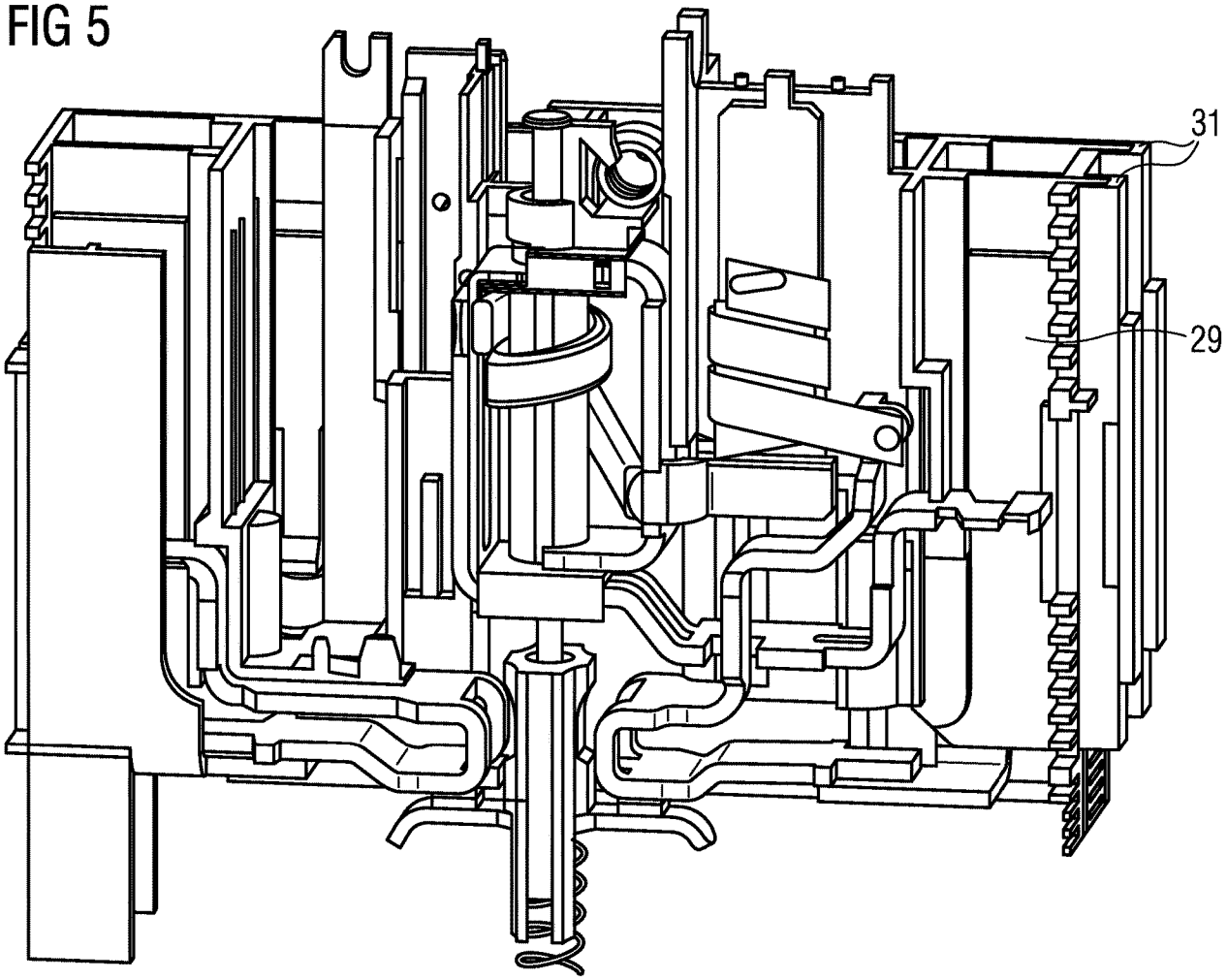
FIG. 5 shows a perspective representation of a further embodiment of the inventive heat extraction apparatus with cooling surfaces, which are arranged in phase-separating housing intermediate walls.

FIG. 5 shows a further, space-optimized housing arrangement of the inventive cooling plate 29. Here the cooling surfaces are preferably arranged in phase-separating housing intermediate walls 31.

By way of an embodiment of the inventive heat extraction apparatus of the switching devices shown here, in particular for circuit breakers, a second effective current path heat extraction route is enabled so that larger power losses can be discharged, so that higher rated current densities of the devices are possible with the installation volume remaining the same. Here the thermal discharge surfaces are integrated in a space-optimized manner in the switching device in the form of cooling plates, such that the surfaces are neither used nor covered. On account of the second heat extraction path observed from the contact point into the cooling plate, a favorable decoupling of the thermal release from heat-specific fluctuations of the contact transition point advantageously takes place, as a result of which the release behavior of the switching device is influenced favorably. The space-optimized heat extraction apparatus described here therefore enables both a reduction in the temperature level overall and also an improvement in the limit current release behavior.

The invention claimed is:

1. A switching device, comprising:

a thermal release including;

a moveable switching piece having two ends and arranged on the thermal release via a contact link support, the moveable switching piece being mounted on a spring body and having a pair of contact points mounted on the moveable switching piece;

stationary switching pieces arranged opposite the movable switching piece, each of the stationary switching pieces having a stationary contact point arranged to contact a respective one of the contact points of the moveable switching piece, wherein the stationary switching pieces each have a first end connected to a terminal connector and a second end being a heat extraction apparatus connecting end; and a plurality of heat extraction apparatuses, each made of a heat-dissipating material, wherein a respective one of the plurality of heat extraction apparatuses is arranged laterally on a respective one of the heat extraction apparatus connecting ends of the stationary switching pieces, at least one of the plurality of the heat extraction apparatuses has a first connection point directly joined to the heat extraction apparatus connecting end and a second connection point separate from the first connection point, and wherein the heat extraction apparatuses electrically interconnect the first end and the second end of the stationary switching pieces, and wherein the second connection point is directly joined to the first end.

2. The switching device of claim 1, wherein the heat extraction apparatuses are each embodied as a cooling plate.

3. The switching device of claim 2, wherein the cooling plates are embodied as cooling ribs.

4. The switching device of claim 1, wherein at least one of the heat extraction apparatuses is arranged on a respective one of the stationary switching pieces and on a respective connecting tongue of the thermal release.

5. The switching device of claim 1, wherein at least one of the heat extraction apparatuses is arranged in phase-separating housing intermediate walls.

6. The switching device of claim 2, wherein at least one of the heat extraction apparatuses is arranged on a respective one of the stationary switching pieces and on a respective connecting tongue of the thermal release.

7. The switching device of claim 2, wherein at least one of the heat extraction apparatuses is arranged in phase-separating housing intermediate walls.

8. The switching device of claim 1, wherein the stationary contact points are disposed on the stationary switching pieces between the heat extraction apparatuses and the first end of the stationary switching pieces along the current flow path.

9. The switching device of claim 2, wherein a respective pair of cooling plates sandwich a respective heat extraction apparatus connecting end therebetween.

* * * * *